US007059483B2

(12) United States Patent
Scudder

(10) Patent No.: US 7,059,483 B2
(45) Date of Patent: Jun. 13, 2006

(54) HANGING FILE FOLDER AND SUSPENSION BAR THEREFOR AND PROCESS FOR PRODUCING

(76) Inventor: Robert A. Scudder, 2130 Laurel Ave., Upland, CA (US) 91784

( * ) Notice: Subject to any disclaimer, the term of this patent is extended or adjusted under 35 U.S.C. 154(b) by 327 days.

(21) Appl. No.: 10/651,345

(22) Filed: Aug. 28, 2003

(65) Prior Publication Data

US 2005/0051506 A1 Mar. 10, 2005

(51) Int. Cl.
*A47F 7/16* (2006.01)

(52) U.S. Cl. ..... 211/46; 211/183; 312/184

(58) Field of Classification Search ..... 211/46, 211/26, 183; 312/183, 184; 428/131, 136
See application file for complete search history.

(56) References Cited

U.S. PATENT DOCUMENTS

| | | | | | |
|---|---|---|---|---|---|
| 2,043,462 | A | | 6/1936 | Brennan | 24/153 |
| 2,318,077 | A | | 5/1943 | Jonas | 129/16.7 |
| 2,536,792 | A | | 1/1951 | Wendt | 24/153 |
| 2,678,651 | A | | 5/1954 | DeWhalley | 129/16 |
| 2,910,985 | A | | 11/1959 | Epstein et al. | 129/16.8 |
| 3,238,947 | A | | 3/1966 | Churnick | 129/16.8 |
| 3,244,179 | A | | 4/1966 | Porteous et al. | 129/16.8 |
| 3,570,678 | A | * | 3/1971 | Lundberg | 211/46 |
| 3,726,409 | A | * | 4/1973 | Skousen | 211/46 |
| 3,850,488 | A | | 11/1974 | Elias et al. | 312/184 |
| 3,913,995 | A | * | 10/1975 | Malcik et al. | 312/183 |
| 3,957,321 | A | | 5/1976 | Rose | 312/184 |
| 3,977,527 | A | * | 8/1976 | Rose et al. | 211/46 |
| 4,053,057 | A | | 10/1977 | Snowden | 211/126 |
| 4,056,296 | A | * | 11/1977 | Hedstrom et al. | 312/184 |
| 4,105,268 | A | | 8/1978 | Elias et al. | 312/184 |
| RE29,751 | E | | 9/1978 | Elias et al. | 312/184 |
| 4,193,218 | A | * | 3/1980 | Mermelstein | 40/374 |
| 4,236,770 | A | | 12/1980 | Moore et al. | 312/184 |
| 4,420,086 | A | | 12/1983 | Bardes | 211/46 |
| 4,652,165 | A | * | 3/1987 | Bertesi et al. | 402/4 |
| 5,052,646 | A | | 10/1991 | Hawes, Jr. et al. | 248/214 |
| 5,197,762 | A | * | 3/1993 | Abramov | 281/43 |
| 5,248,290 | A | | 9/1993 | Hawes, Jr. et al. | 493/379 |
| D356,830 | S | | 3/1995 | Messier | D19/90 |
| D382,301 | S | | 8/1997 | Baumgarten | D19/99 |
| 5,722,692 | A | | 3/1998 | Abramov | 281/43 |
| 6,227,746 | B1 | * | 5/2001 | Long et al. | 402/4 |

FOREIGN PATENT DOCUMENTS

GB 2207638 2/1989

* cited by examiner

*Primary Examiner*—Jennifer E. Novosad
(74) *Attorney, Agent, or Firm*—F. Eugene Logan

(57) ABSTRACT

A suspension bar for a hanging file having coplanar longitudinal top and bottom portions and a longitudinal middle portion having an offset parallel to the coplanar longitudinal top and bottom portions. A traverse perimeter flare is around each notch. A plurality of small depressed sections in the longitudinal middle portion are expanded to prevent nesting of stacked suspension bars. The notches of the suspension bars are coated to reduce friction. Sheet metal stock need be only half the thickness of conventional flat suspension bar stock with the same load-supporting capacity when incorporated in a hanging file folder thereby lowering manufacturing cost of suspension bars and hanging file folders. This invention also includes a process for making the suspension bars and for installing the suspension bars in jackets at a high production rate, including automated production lines.

34 Claims, 6 Drawing Sheets

HANGING FILE FOLDER AND SUSPENSION BAR THEREFOR AND PROCESS FOR PRODUCING

BACKGROUND OF THE INVENTION

Various types of suspension bars for hanging file folders, posters and magazines in file cabinets are known, however, it is believed that only a few of such suspension bars are currently in use, perhaps because of complexity or usefulness and/or cost. One type of suspension bar involves folding thin metal strips or other suitable material over the ends of file folder jackets and crimping or pinning the jacket between the folds, for example as in:

| U.S. Pat. No. | Feature |
|---|---|
| 2,678,651 | Crimping. |
| 2,910,985 | Series of crimps with complementary grooves. |
| 3,238,947 | Series of crimps with complementary grooves. |
| 3,244,179 | Series of crimps with complementary grooves. |
| 4,053,057 | Series of crimps with complementary grooves for only one suspension bar. |
| 4,236,770 | One long crimp with complementary long groove. |
| 4,420,086 | Hinged with removable pins. |

None of these suspension bars are intended for installing in pockets of file folder jackets.

Another type of suspension bar is disclosed in GB 2,207,638 wherein a jacket made of a plastic material is welded to a suspension bar made of a second plastic material. Referring to FIGS. 3 to 5 therein, raised platforms 17 are located upon a recess 13 which is complementary in shape to projecting ribs 12 on the hangers. Interlocking button 8 locks one hanging file folder to an adjacent one. The suspension bar does not appear to be suitable for installing in pockets of file folder jackets.

Still another type of suspension bar is disclosed in U.S. Pat. No. 4,105,268 wherein several L-like shaped suspension bars support various types of fasteners for hanging different items. Similarly, U.S. Pat. Nos. 3,850,488 and Re. 29,751 disclose several Z-like shaped suspension bars from which various fasteners and other articles can be hung. Neither the L-like or Z-like shaped suspension bars are suitable for installing in pockets of file folder jackets.

Compression bars, featuring a prong component and a base component, for clamping sheets or folders between the two components are disclosed in the following patents:

| U.S. Pat. No. | Feature |
|---|---|
| 2,043,462 | Prong component received in base component having reinforcing ribs. |
| 2,536,792 | Prong component received in base component both having reinforcing ribs. |
| 3,957,321 | Opposing compressor bars having rails with slidable hooks. |

None of these compression bars are suitable for installing in pockets of file folder jackets.

Support bars having an elongated slot for hanging items therefrom are disclosed in:

| U.S. Pat. No. | Feature |
|---|---|
| Des. 356,830 | For hanging magazines. |
| Des. 382,301 | For hanging files. |
| 5,722,692 | For hanging booklets. Support bar has a stiffening rib. |

None of these support bars are suitable for installing in pockets of file folder jackets.

Hanging file folders with a jacket pocket for housing a flat suspension bar are disclosed in U.S. Pat. Nos. 5,248,290 and 5,052,646. U.S. Pat. No. 4,053,057, mentioned above, also has one conventional flat suspension bar 14 of the type typically used in the pockets of most hanging file folders.

U.S. Pat. No. 2,318,077, has channels into which suspension bars are installed. The suspension bars are flat except for dimples 7 (FIGS. 1–5), or V-shaped ears or lugs 8 (FIGS. 6–9), or bosses 11 (FIGS. 10–13). The dimples, lugs and bosses are to maintain vertical and horizontal alignment of adjacent file folders in a file cabinet.

SUMMARY OF THE INVENTION

An object of this invention is to lessen the cost of mass production on assembly lines of hanging file folders and the suspension bars therefor.

Another object of this invention is to provide a suspension bar of lighter weight with the same, or better, load-supporting capacity of conventional suspension bars thereby lessening the cost of producing suspension bars.

Still another object of this invention is to produce suspension bars from a stock having half, or less than half, the weight of conventional suspension bars made from the same stock thereby lessening the cost thereof.

Still another object of this invention is to produce suspension bars from a stock having half, or less than half, the thickness of conventional suspension bars made from the same stock thereby lessening the cost thereof.

Another object of this invention is to produce light weight hanging file folders thereby lessening the cost of shipping weight charges.

Still another object of this invention is to produce light weight hanging file folders thereby lessening the weight of hanging file folders in storage devices and facilities.

Yet another object of this invention is to provide a suspension bar that can be fed at a high rate on an automatic assembly line for the production of hanging file folders.

Another object of this invention is to provide a process for producing the suspension bars of this invention.

Still another object of this invention is to provide a highly automated high speed process for producing the suspension bars of this invention.

DESCRIPTION OF THE PREFERRED EMBODIMENTS

Figure 1:
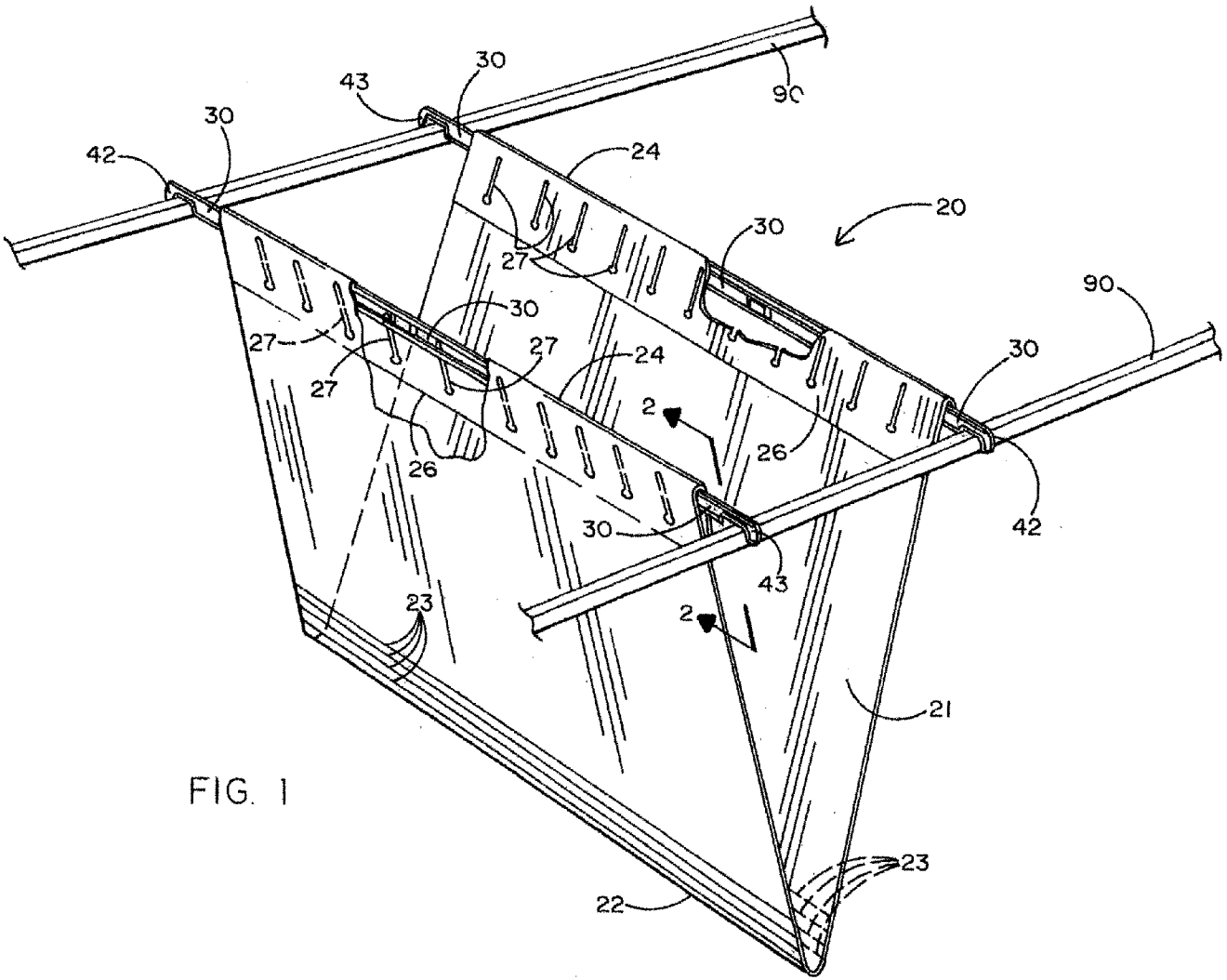
FIG. 1 is a top front perspective view of the hanging file folder with break-out portions showing parts of the suspension bars.
Figure 2:
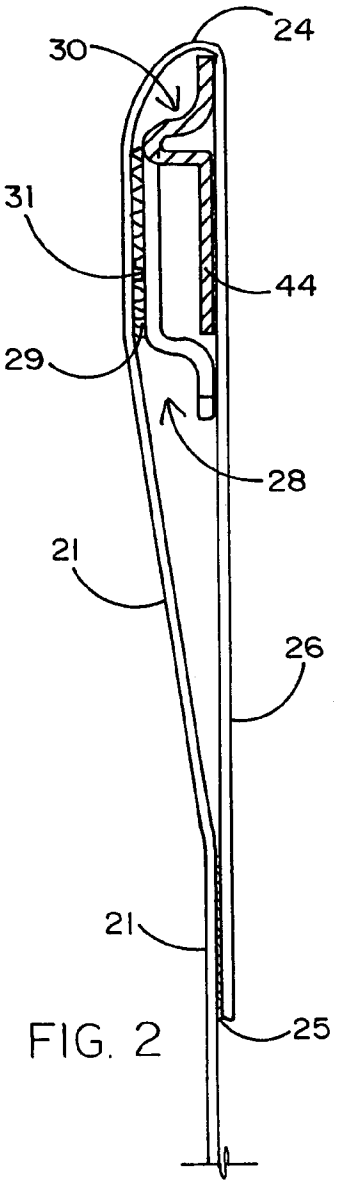
FIG. 2 is a greatly enlarged end view of the top portion of the hanging file folder taken in the direction 2—2 of FIG. 1.
Figure 3:
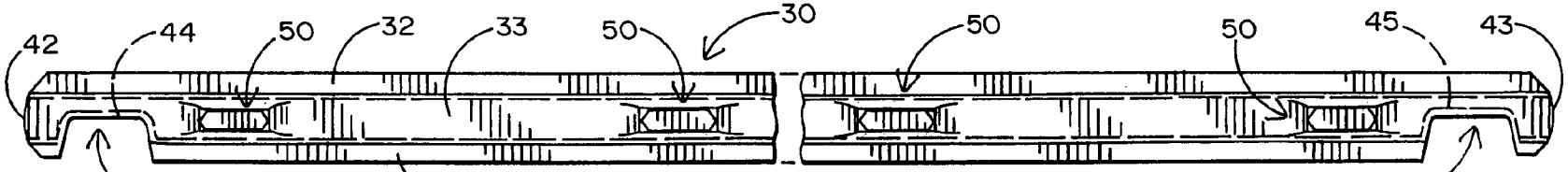
FIG. 3 is an enlarged front view of the suspension bar of FIG. 1.
Figure 4:
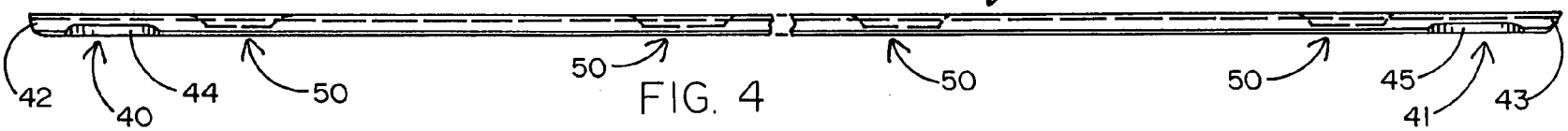
FIG. 4 is a bottom view of the suspension bar of FIG. 3.

With reference to the drawings, FIGS. 1 and 2 show a hanging file folder and suspension bar of this invention. In particular, FIG. 1 shows a hanging file folder 20 that comprises foldable jacket 21 folded along medial line 22 with a plurality of crease lines 23 on each side of medial line 22, and suspension bars 30.

Jacket 21 is formed from heavy paper or card stock, plastic, fabric or other suitable flexible material. The top parts 24 of jacket 21 are folded inwardly and over suspension bars 30 to form inward flaps 26 thereby forming pockets 28. Flaps 26 comprise a plurality of equally spaced apart vertical slots 27 for receiving insertable resilient locating arms of conventional flexible plastic tabs (not shown in the drawings). Top parts 24 also have predetermined fold lines that enable folding the ends of jacket over the suspension bars during manufacture of hanging file folders 20. The inside of flaps 26 of jacket 21 are glued by glue swath 25 to opposing inside surfaces of jacket 21 thereby bonding flaps 26 to jacket 21 and forming pockets 28.

In the embodiment shown in the drawings, suspension bars 30 are identical construction. In one embodiment of this invention, front surface 31 of longitudinal middle portion 33 of suspension bar 30 is glued by glue swath 29 to pocket 28, to prevent the bar from sliding out of pocket 28. The thickness of glue swaths 25 and 29 has been disproportionately enlarged in FIG. 2 for clarity, it being understood that glue swaths 25 and 29 have very little, if any, width after setting.

With the hanging file folder folded about medial line 22, suspension bars 30 are preferably oriented as shown in FIG. 2. If desired, one or both of the suspension bars can be reversely oriented, however, the arrangement shown in FIG. 2 is most preferable for both suspension bars because gluing of taller front surface 31 of longitudinal middle portion 33 of the suspension bar to the jacket is more effective than trying to glue the rear surface of the suspension bar to the jacket. The relatively large flat front surface 31 of longitudinal middle portion 33 provides a superior bonding surface than if the suspension bar were reversely oriented in the pocket. The relatively large front flat surface 31 of the longitudinal middle portion is also a more effective surface for bonding to than are surfaces that are curved since the stiffness of the typical jacket material and the load in the hanging file folder will tend to rip the jacket away from such curved surfaces. Flaps 26 are not bonded to suspension bar 30 since to do so would interfere with the insertion of the arms of conventional plastic file identity tabs into slots 27.

The arrangement shown in FIG. 2 is also preferred because any bowing of the suspension bar that occurs with very heavy file folder loads will tend to be bowed inward rather than bowed outward. Inward bowing tends to be minimized because it is limited by any file folder in the hanging file folder whereas bowing outward is not. Accordingly, outward bowing is also more stressful on the glued flaps 26 than inward bowing, which can rip the glued area 25 of the flaps away from the inside surface of jacket 21 causing jacket 21 to fail.

Referring also to FIGS. 3–10, suspension bar 30 comprises a longitudinal top portion 32 extending in a first vertical plane 35, a longitudinal bottom portion 34 also extending approximately in the first vertical plane, a longitudinal middle portion 33 extending in a second vertical plane 36 offset from the first vertical plane 35, an upper connective portion 38 connecting longitudinal middle portion 33 to longitudinal top portion 32, and a lower connective portion 39 connecting longitudinal middle portion 33 to longitudinal bottom portion 34. Second vertical plane 36 is parallel to, and offset distance 37 from, first vertical plane 35.

Suspension bar 30 further comprising first notch 40 proximate first distal end 42 of suspension bar 30, and second notch 41 proximate second distal end 43 of suspension bar 30, for engaging and sliding along a pair of parallel support rails 90 or internal edges of an apparatus (not shown in the drawings) for storing a plurality of hangable file folders; for example file cabinets and the like.

In this embodiment, notches 40 and 41 are entirely through a part of longitudinal bottom portion 34 and lower connective portion 39, partly through a part of longitudinal middle portion 33, but not through any part of upper connective portion 38 and longitudinal top portion 32. Thus it can be seen that longitudinal top portion 32 and upper connective portion 38 extend approximately the full length of suspension bars 30. Longitudinal bottom portion 34, longitudinal middle portion 33 and lower connective portion 39 also extend approximately the full length of suspension bars 30 interrupted only by notches 40 and 41.

Figure 5:
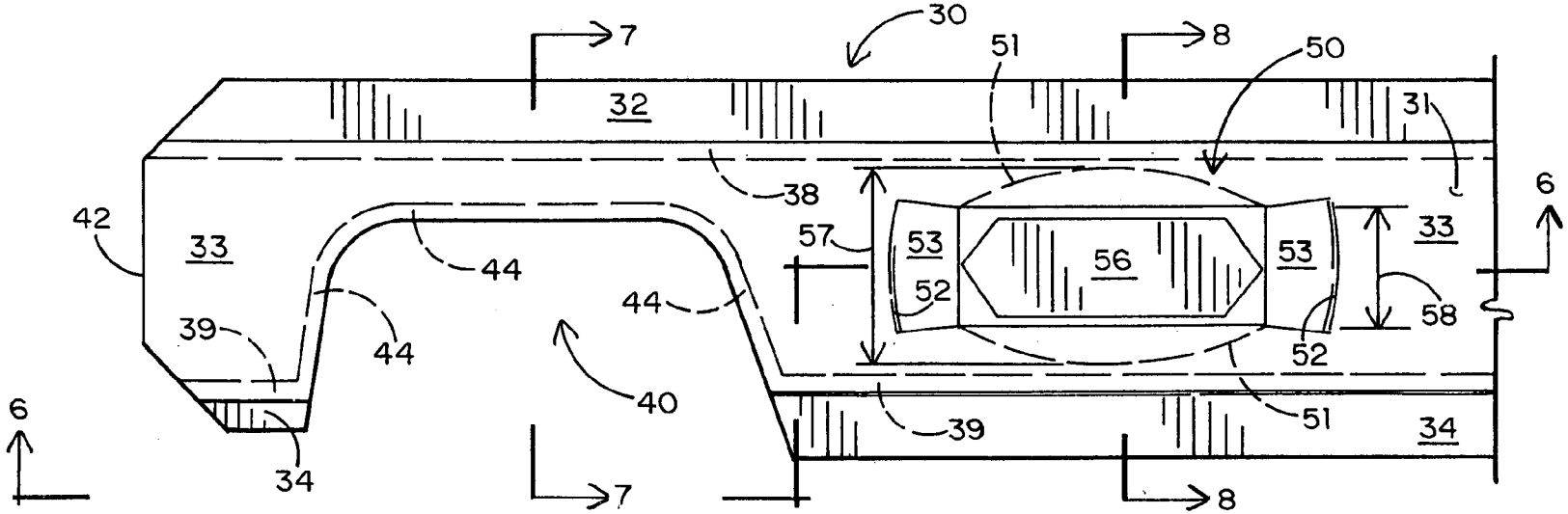
FIG. 5 is a greatly enlarged frontal section of a first end of the suspension bar of FIG. 1. The frontal section of the other end, or second end, of the suspension bar being the mirror image of FIG. 5.

First and second notches 40 and 41 further comprise first and second traverse perimeter flares 44 and 45, respectively, which strengthen and stabilize the notches. FIG. 5 shows in part, front side 31 of longitudinal middle portion 33 of the first end 42 of suspension bar 30 with first traverse perimeter flare 44 around first notch 40. Second end 43, second notch 41 and second traverse perimeter flare 45 around second notch 41, are collectively the mirror image of first distal end 42, first notch 40 and first traverse perimeter flare 44. In other words the second end of suspension bar 30 is the mirror image of both FIG. 5 and FIG. 6.

Figure 7:
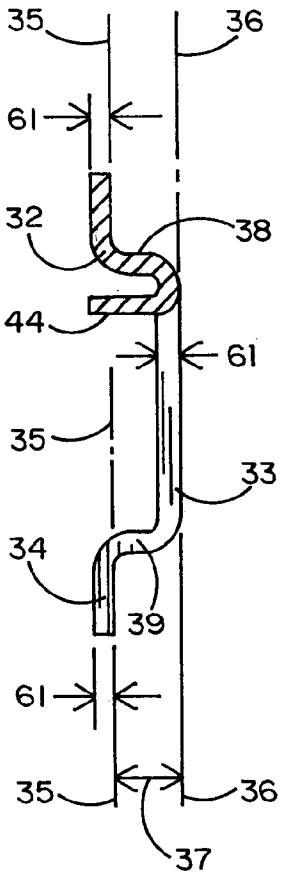
FIG. 7 is a section of the suspension bar taken through line 7—7 of FIG. 5.
Figure 6:
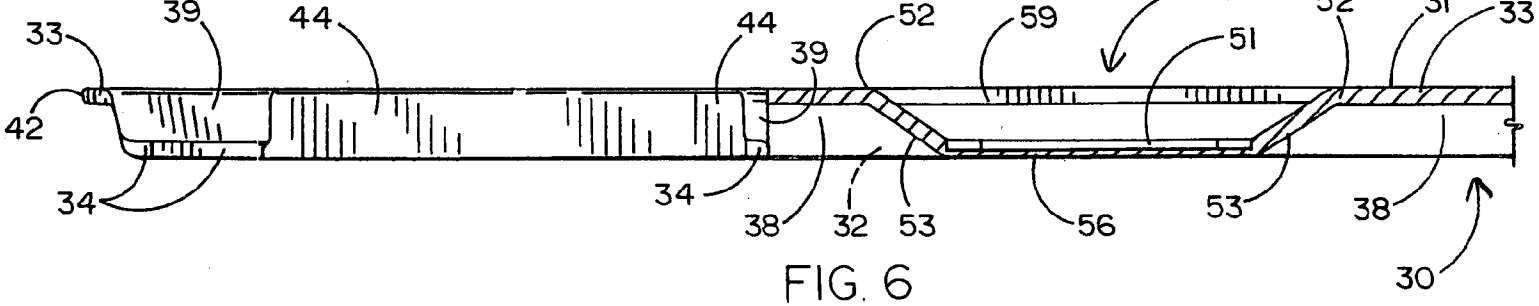
FIG. 6 is a bottom section of the first end of the suspension bar taken through staggered line 6—6 of FIG. 5. The bottom section of the other, or second end, of the suspension bar being the mirror image of FIG. 6.

In this embodiment, traverse perimeter flares 44 and 45 extend traversely from longitudinal middle portion 33 proximate to vertical alignment with the rear surface of longitudinal top and bottom portions 32 and 34, respectively. As shown in FIGS. 6 and 7.

Figure 8:
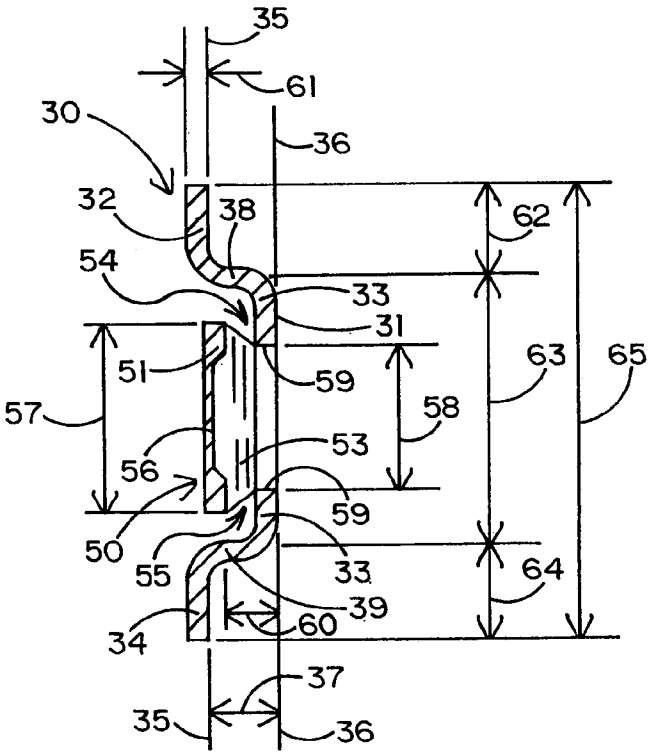
FIG. 8 is a section taken of the suspension bar through line 8—8 of FIG. 5.

In a preferred embodiment, the suspension bar further comprises a plurality of nesting-prevention means 50, seen in FIGS. 5, 6 and 8, that are traversely dependent from longitudinal middle portion 33 proximate to first vertical plane 35. Means 50 has small depressed section 51 offset proximate to first vertical plane 35, or more preferably flush with the longitudinal top and bottom portions 32 and 34, respectively, so that small depressed section 51 also lies in first vertical plane 35.

For clarity, in the embodiment shown in FIGS. 6 and 8, small depressed section 51 knock-back distance 60 does not quite extend to flush vertical alignment with longitudinal top and bottom portions 32 and 34. It is to be understood that knock-back distance 60 is to be effective for preventing nesting for the particular suspension bars being produced. In general, a ratio of the knock-back distance 60 to the offset distance 37 is from about 0.6 to about 1.2.

Small depressed section 51 has connecting end tabs 53 that are attached at ends 52 to longitudinal middle portion 33. However, small depressed section 51 is partly separated from longitudinal middle portion 33 by spaced apart narrow upper and lower slits 54 and 55 that span approximately the full length of small depressed section 51. Central section 56, located longitudinally and centrally within small depressed section 51, has been compressed or coined thereby vertically expanding small depressed section 51 to height 57 that is greater than the slot height 58 of slot 59.

Although the small depressed section is expanded in the vertical direction in this example, it is to understood that the paired slits can be vertically oriented in longitudinal middle portion 33 and the small depressed section expanded longitudinally which will also prevent nesting.

In the embodiment shown in the drawings there are four spaced apart nesting-prevention means 50. However, the number of means 50 should be sufficient to prevent the suspension bars from nesting together when stacked. The number of nesting-prevention means 50 may vary depending on the length of the suspension bar with longer suspension bar requiring more than four, for example with legal size hanging file folders the suspension bars can be produced with five or six or more of nesting-prevention means 50.

Without nesting-prevention means 50 the suspension bars, when stacked front side of one bar to the rear side of another bar, may become so tightly packed together that they nest together making separation very difficult, time consuming and hence costly. Since expanded height 57 of small depressed section 51 is larger than slot height 58 of the slot 59 the suspension bars will not nest together and difficulties such as suspension bar misfeeding or jamming will not occur in an automated assembly line that feeds stacked suspension bars rapidly one at a time onto and/or into jackets 21 at a high rate of speed while still permitting the suspension bars to remain in stacked alignment prior to ejection from a continuous suspension bar feeder.

In this embodiment of this invention, the longitudinal top, middle and bottom portions 32, 33 and 34, and the upper and lower connective portions 38 and 39 of metal suspension bar have the same thickness indicated by element 61. In one embodiment the metal thickness is about 0.012 inches (0.30 mm). This compares to a metal thickness of conventional suspension bars of about 0.025 inches (0.635 mm).

In this embodiment, the heights of the longitudinal top portion 32 and the longitudinal bottom portion 34 are about equal as defined by height elements 62 and 64, respectively. In this embodiment, the height of the longitudinal middle portion 33 as defined by element 63, is from about 2 to about 4 times the height of the longitudinal top portion 32 as defined by element 62.

Also in this embodiment, height 63 of longitudinal middle portion 33 is from about 0.5 to about 0.7 of the overall height of the suspension bar as defined by element 65.

Still further, in this embodiment the height 63 of longitudinal middle portion 33 is from about 2 to about 4 times the offset distance 37 of longitudinal middle portion 33 from longitudinal top and bottom portions 32 and 34.

In this embodiment the thickness 61 of the stock of suspension bar 30 is from about 0.2 to about 0.4 times the offset distance 37 of longitudinal middle portion 33 from longitudinal top and bottom portions 32 and 34.

Further too, in this embodiment the knock-back distance 60 of small depressed section 51 from longitudinal middle portion 33 is from about 0.6 to about 1.2 times the offset distance 37 of longitudinal middle portion 33.

In this embodiment, suspension bar 30, when used to produce a hangable file folder, has a hanging load strength of at least that of a totally flat suspension bar of twice the thickness with the same height.

Also in this embodiment, suspension bar 30, when used to produce a hangable file folder, has a hanging load strength of at least that of a totally flat suspension bar of twice the weight with the same stock.

In this embodiment, the height of the cut, but unbent stock used to produce suspension bar 30 is about 0.310 inches, which when bent as shown in the drawings to form the offset, has a final overall height of about 0.275 inches prior to coating.

Figure 9:
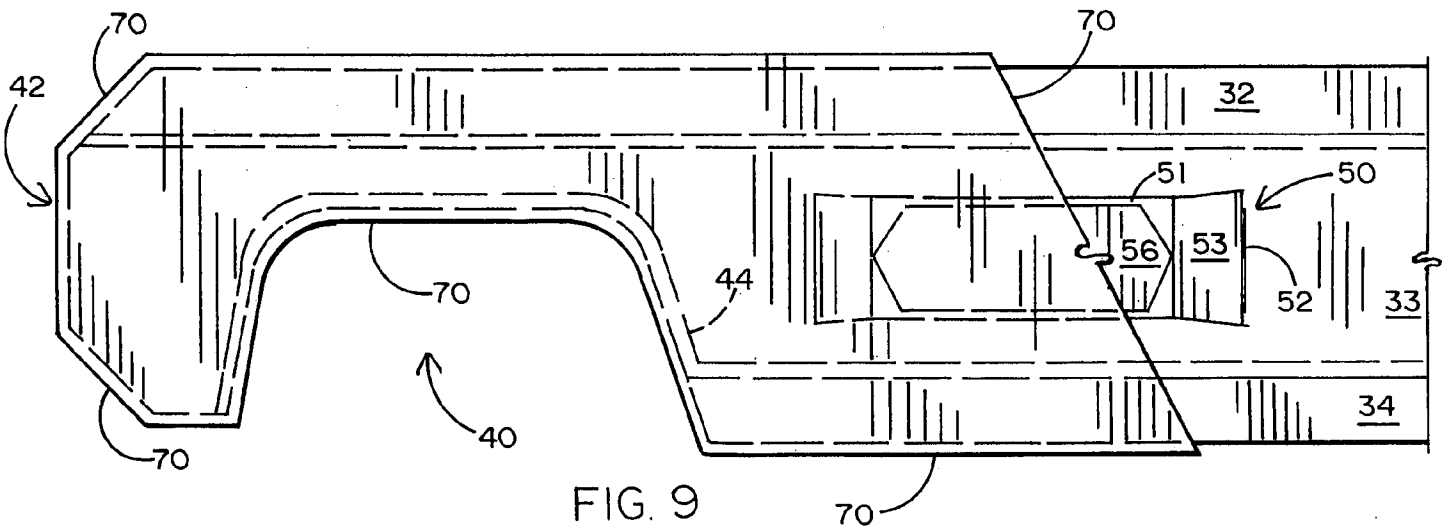
FIG. 9 is similar to FIG. 7 but with a friction-reducing coating on the rail engaging area of the suspension bar.

In a further embodiment, the first and second distal ends 42 and 43 are coated on each end, front and rear, and top and bottom with from about 0.008 inches (0.20 mm) to about 0.010 inches (0.25 mm) of friction-reducing coating material such as nylon or polyester by powder coating as indicated by element 70 in FIG. 9.

Furthermore, in this embodiment, excluding the application of coating 70, suspension bar 30 has a configuration that is effective for manufacturing from sheet metal stock solely by stamping, bending and cutting without any heating, tempering, or annealing up to applying the friction-reducing coating. However, heating of the distal ends of the suspension bars is preferably conducted immediately prior to the final application of a powder coating over distal ends 42 and 43 to improve the bonding of the powder coating to the suspension bar.

Figure 10:
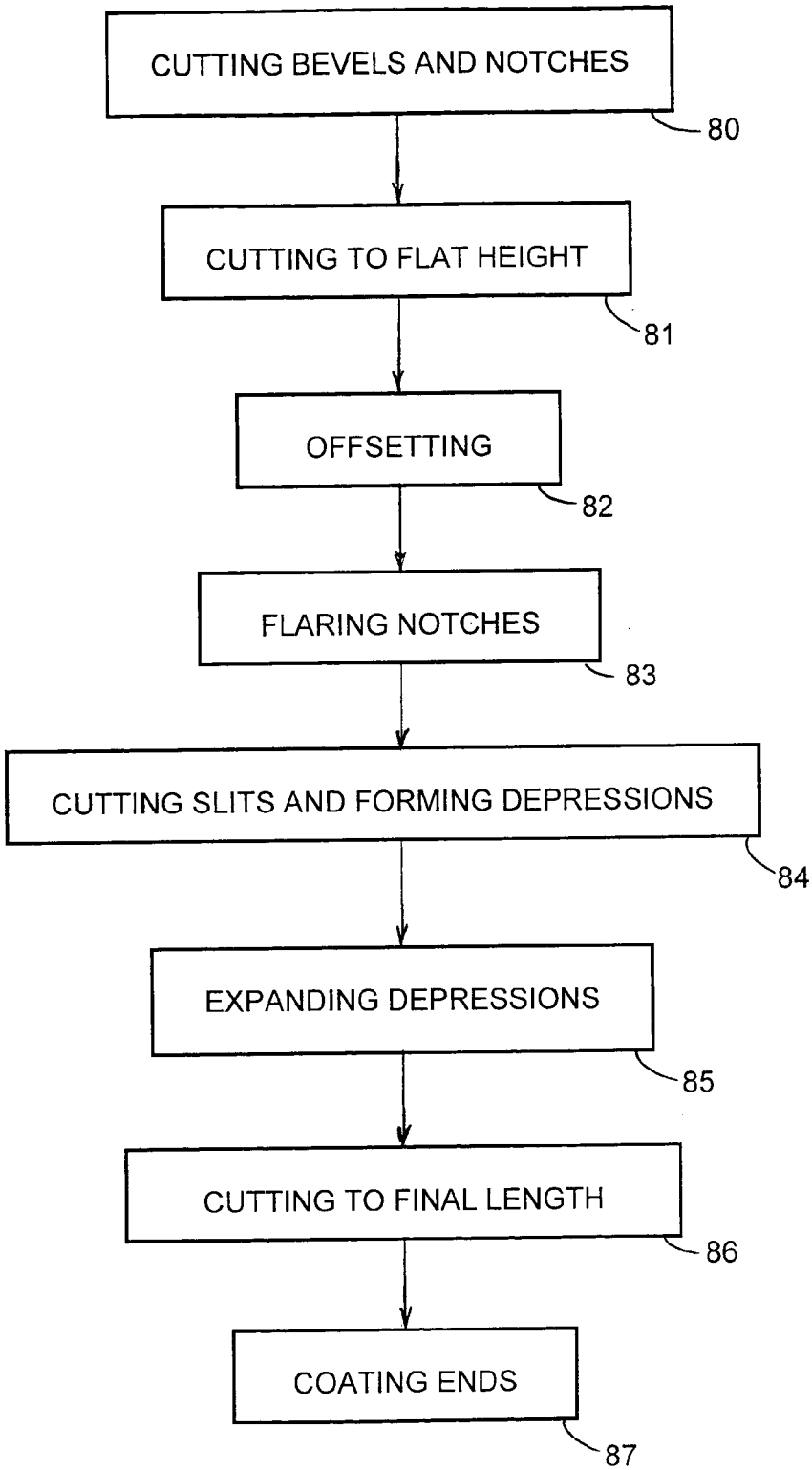
FIG. 10 is a flow diagram of a process for producing suspension bars.

With reference to FIG. 10, there is also provided by the principles of this invention a process for producing suspension bars for hanging file folders comprising a step 80 of cutting bevels and notches for a plurality of suspension bars from flat sheet stock, a step 81 of cutting the beveled and notched stock to a flat preoffset height, and a step 82 forming coplanar longitudinal top and bottom portions and a longitudinal middle portion having an offset parallel to the coplanar longitudinal top and bottom portions thereby producing offset stock.

In this embodiment of this invention, the process further comprises a step 83 of forming a traverse perimeter flare around each notch of the offset stock thereby producing flared stock.

In a further embodiment of this invention, the process further comprises a step 84 of cutting a plurality of paired slits in the longitudinally middle portion of the flared stock and forming a small depressed section between each of the paired slits thereby producing depressed section-containing stock, and a step 85 of expanding each small depressed section in the depressed section-containing stock thereby producing stock with nesting prevention means.

In yet a further embodiment, of this invention the process further comprises a step 86 of cutting the stock with nesting prevention means to a final longitudinal length thereby producing suspension bars.

In an especially preferred embodiment of this invention, the process further comprises a step 87 of forming a friction-reducing coating around the surface of each notch and the small depressed section proximate to each of the notches.

There is also provided by the principles of this invention an automated process for producing hanging file folders comprising installing offset, sized and coated suspension bars in jackets.

Figure 11:
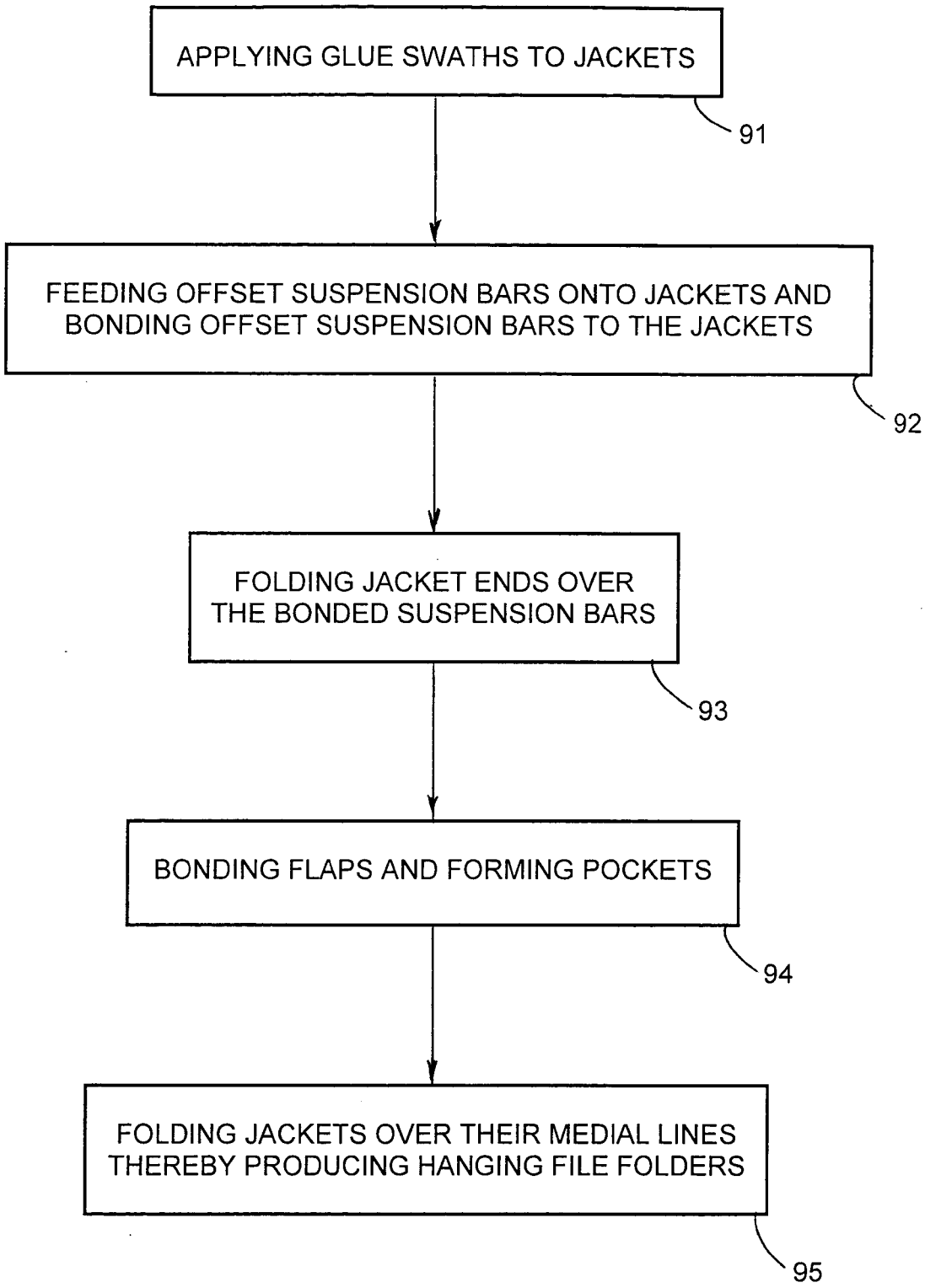
FIG. 11 is a flow diagram of a process for producing hanging file folders.

With reference to FIG. 11, there is provided by the principles of this invention a process, which is suitable for high speed automated manufacturing, for producing hanging file folders comprising applying glue swaths to sized jackets in step 91; bonding offset, sized and coated suspension bars on the jackets in step 92; folding ends of the sized jackets over the suspension bars in step 93; bonding the flaps to the inside surface of the jackets thereby forming pockets in step 94; and folding the jackets over a medial line thereby producing hanging file folders in step 95.

While the preferred embodiments of the present invention have been described, various changes, adaptations and modifications may be made thereto without departing from the spirit of the invention and the scope of the appended claims. The present disclosure and embodiments of this invention described herein are for purposes of illustration and example and modifications and improvements may be made thereto without departing from the spirit of the invention or from the scope of the claims. The claims, therefore, are to be accorded a range of equivalents commensurate in scope with the advances made over the art.

What is claimed is:

1. A suspension bar for a hangable file folder comprising:

a longitudinal top portion extending in a first vertical plane;

a longitudinal bottom portion extending in the first vertical plane;

a longitudinal middle portion extending in a second vertical plane parallel to, and offset from, the first vertical plane;

an upper connective portion connecting the longitudinal middle portion to the longitudinal top portion; and a lower connective portion connecting the longitudinal middle portion to the longitudinal bottom portion, and wherein when the first vertical plane and the second vertical plane are viewed with the longitudinal top portion on top and the longitudinal bottom portion on bottom, the longitudinal top portion extends above the longitudinal middle portion and the longitudinal bottom portion extends below the longitudinal middle portion.

2. The suspension bar of claim 1, wherein the top, middle and longitudinal bottom portions, and the upper and lower connective portions have a same thickness.

3. The suspension bar of claim 2, further comprising nesting-prevention means for preventing a stack of the suspension bars, when stacked so that the rear surface of one suspension bar faces the front surface of another suspension bar, from nesting together.

4. The suspension bar of claim 1, further comprising notches proximate distal ends of the suspension bar for engaging and sliding along rails of an apparatus for holding the hangable file folder.

5. The suspension bar of claim 3, wherein the notches further comprise a traverse perimeter flare.

6. The suspension bar of claim 5, wherein the suspension bar consists of only one piece.

7. The suspension bar of claim 4, wherein the notches are entirely through a part of the longitudinal bottom portion and an associated part of the lower connective portion, and partly through an associated part of the longitudinal middle portion but not through any part of the longitudinal top portion nor any part of the upper connective portion.

8. The suspension bar of claim 4, wherein the notches further comprise a traverse perimeter flare that extends from the longitudinal middle portion to at least about the first vertical plane.

9. The suspension bar of claim 8, wherein the suspension bar has a configuration that is operable for manufacturing from sheet metal stock solely by stamping, bending and cutting.

10. The suspension bar of claim 8, wherein the suspension bar consists of only one piece.

11. The suspension bar of claim 4, wherein the suspension bar consists of only one piece.

12. The suspension bar of claim 1, wherein the longitudinal top, bottom and middle portions have heights, wherein the heights of the longitudinal top portion and the longitudinal bottom portion are about equal, and wherein a ratio of the height of the longitudinal middle portion to the vertical height of the longitudinal top portion is from about 2 to about 4.

13. The suspension bar of claim 1, wherein the longitudinal middle portion has a height, and wherein a ratio of the height to the offset is from about 3 to about 5.

14. The suspension bar of claim 1 incorporated in a hanging file folder.

15. The suspension bar of claim 1, further comprising nesting-prevention means for preventing a stack of the suspension bars, when stacked so that the rear surface of one suspension bar faces the front surface of another suspension bar, from nesting together.

16. The suspension bar of claim 15, wherein the offset spans an offset distance, wherein the nesting-prevention means is dependent from the longitudinal middle portion towards the first vertical plane a knock-back distance, and wherein a ratio of the knock-back distance to the offset distance is from about 0.6 to about 1.2.

17. The suspension bar of claim 16, wherein the nesting-prevention means has a depressed section dependent from, and supported by, the longitudinal middle portion.

18. The suspension bar of claim 17, wherein the depressed section has a plurality of spaced apart paired slits separating a part of the depressed section from the longitudinal middle portion.

19. The suspension bar of claim 18, wherein the depressed section is expanded an amount effective far preventing the suspension bars from nesting together.

20. The suspension bar of claim 15, wherein the suspension bar consists of only one piece.

21. The suspension bar of claim 1, wherein the suspension bar has an overall height, wherein the longitudinal middle portion has a middle portion height, and wherein a ratio of the middle portion height to the overall height is from about 0.5 to about 0.7.

22. The suspension bar of claim 1, wherein the suspension bar consists of only one piece.

23. A suspension bar for a hangable file folder comprising:

a longitudinal top portion extending in a first vertical plane;

a longitudinal bottom portion extending in the first vertical plane;

a longitudinal middle portion extending in a second vertical plane parallel to, and offset from, the first vertical plane;

an upper connective portion connecting the longitudinal middle portion to the longitudinal top portion;

a lower connective portion connecting the longitudinal middle portion to the longitudinal bottom portion; and notches proximate distal ends of the suspension bar for engaging and sliding along rails of an apparatus for holding the hangable file folder, wherein the notches are entirely through a part of the longitudinal bottom portion and an associated part of the lower connective portion, and partly through an associated part of the longitudinal middle portion but not through any part of the longitudinal top portion nor any part of the upper connective portion.

24. A suspension bar for a hangable file folder comprising:

a longitudinal top portion extending in a first vertical plane;

a longitudinal bottom portion extending in the first vertical plane;

a longitudinal middle portion extending in a second vertical plane parallel to, and offset from, the first vertical plane;

an upper connective portion connecting the longitudinal middle portion to the longitudinal top portion;

a lower connective portion connecting the longitudinal middle portion to the longitudinal bottom portion; and notches proximate distal ends of the suspension bar for engaging and sliding along rails of an apparatus for holding the hangable file folder, wherein the notches further comprise a traverse perimeter flare that extends from the longitudinal middle portion to at least about the first vertical plane.

25. The suspension bar of claim 24, wherein the suspension bar has an overall height, wherein the top, middle and longitudinal bottom portions, and the upper and lower connective portions have a same thickness, wherein the suspension bar is made from a stock, and wherein, when the suspension bar is used to produce a hangable file folder, the suspension bar has a hanging-load bearing strength that is at least equal to a hanging-load bearing strength of a totally flat suspension bar made from said stock and having an overall height equal to said first mentioned overall height but having a thickness equal to twice said first mentioned thickness.

26. The suspension bar of claim 24, wherein the suspension bar is made from a metal and has a weight, wherein the top, middle and longitudinal bottom portions, and the upper and lower connective portions have a same thickness, and wherein, when the suspension bar is used to produce a hangable file folder, the suspension bar has a hanging-load bearing strength that is at least equal to a hanging-load bearing strength of a suspension bar having a totally flat cross-section made of said metal but having a weight equal to twice said first mentioned weight.

27. The suspension bar of claim 24, wherein the suspension bar has a configuration that is operable for manufacturing from sheet metal stock solely by stamping, bending and cutting.

28. A suspension bar for a hangable file folder comprising:

a longitudinal top portion extending in a first vertical plane;

a longitudinal bottom portion extending in the first vertical plane;

a longitudinal middle portion extending in a second vertical plane parallel to, and offset from, the first vertical plane;

an upper connective portion connecting the longitudinal middle portion to the longitudinal top portion;

a lower connective portion connecting the longitudinal middle portion to the longitudinal bottom portion, and wherein the top, middle and longitudinal bottom portions and the upper and lower connective portions have a same thickness; and nesting-prevention means for preventing a stack of the suspension bars, when stacked so that the rear surface of one suspension bar faces the front surface of another suspension bar, from nesting together, and wherein the offset spans an offset distance, wherein the nesting-prevention means is dependent from the longitudinal middle portion towards the first vertical plane a knock-back distance, and wherein a ratio of the knock-back distance to the offset distance is from about 0.6 to about 1.2.

29. The suspension bar of claim 28, wherein the ratio is about one.

30. The suspension bar of claim 28, wherein the nesting-prevention means has a depressed section dependent from, and supported by, the longitudinal middle portion.

31. The suspension bar of claim 30, wherein the depressed section has a plurality of spaced apart paired slits separating a part of the depressed section from the longitudinal middle portion.

32. The suspension bar of claim 31, wherein the depressed section is expanded an amount effective for preventing the suspension bars from nesting together.

33. The suspension bar of claim 31, wherein the depressed section is expanded an amount effective for preventing the suspension bars from nesting together during high speed manufacture from rolled sheet metal stock.

34. A suspension bar for a hangable file folder comprising:

a longitudinal top portion extending in a first vertical plane;

a longitudinal bottom portion extending in the first vertical plane;

a longitudinal middle portion extending in a second vertical plane parallel to, and offset from, the first vertical plane;

an upper connective portion connecting the longitudinal middle portion to the longitudinal top portion; and a lower connective portion connecting the longitudinal middle portion to the longitudinal bottom portion, and wherein the suspension bar has an overall height, wherein the longitudinal middle portion has a middle portion height, and wherein a ratio of the middle portion height to the overall height is from about 0.5 to about 0.7.

* * * * *